US008410676B2

(12) United States Patent
Feng et al.

(10) Patent No.: US 8,410,676 B2
(45) Date of Patent: Apr. 2, 2013

(54) SHEET-SHAPED HEAT AND LIGHT SOURCE, METHOD FOR MAKING THE SAME AND METHOD FOR HEATING OBJECT ADOPTING THE SAME

(75) Inventors: Chen Feng, Bei-Jing (CN); Peng Liu, Bei-Jing (CN); Kai-Li Jiang, Bei-Jing (CN); Yang Wei, Bei-Jing (CN); Shou-Shan Fan, Bei-Jing (CN)

(73) Assignees: Beijing Funate Innovation Technology Co., Ltd., Beijing (CN); Hon Hai Precision Industry Co., Ltd., New Taipei (TW)

( * ) Notice: Subject to any disclaimer, the term of this patent is extended or adjusted under 35 U.S.C. 154(b) by 511 days.

(21) Appl. No.: 12/006,314

(22) Filed: Dec. 29, 2007

(65) Prior Publication Data

US 2009/0085461 A1 Apr. 2, 2009

(30) Foreign Application Priority Data

Sep. 28, 2007 (CN) ..... 2007 1 0077394

(51) Int. Cl.
*H01K 1/14* (2006.01)

(52) U.S. Cl. ..... 313/315; 313/494; 313/578; 219/260; 219/546; 219/548

(58) Field of Classification Search ..... 313/498, 313/315, 494, 578; 219/260, 548, 546; 977/549, 977/553, 742, 755, 902, 949, 950
See application file for complete search history.

(56) References Cited

U.S. PATENT DOCUMENTS

| | | | | |
|---|---|---|---|---|
| 1,710,512 | A | 4/1929 | Pitt | |
| 3,304,459 | A | 2/1967 | Shaw et al. | |
| 4,563,572 | A | 1/1986 | Hager, Jr. | |
| 5,765,215 | A | 6/1998 | Afsar et al. | |
| 5,998,049 | A | 12/1999 | Tanaka et al. | |
| 6,031,970 | A | 2/2000 | Nordal et al. | |
| 6,037,574 | A | 3/2000 | Lanham et al. | |
| 6,043,468 | A | 3/2000 | Toya et al. | |
| 6,183,714 | B1 | 2/2001 | Smalley et al. | |
| 6,188,839 | B1 | 2/2001 | Pennella | |
| 6,232,706 | B1 * | 5/2001 | Dai et al. | 313/309 |

(Continued)

FOREIGN PATENT DOCUMENTS

| | | |
|---|---|---|
| CN | 1044023 | 7/1990 |
| CN | 2324745 | 6/1999 |

(Continued)

OTHER PUBLICATIONS

Mei Zhang,et al. Strong, Transparent, Mutifunctional,Carbon Nanotube Sheets. Science, Aug. 19, 2005,1215-1219,309,The American Association for the Advancement of Science, USA.

(Continued)

*Primary Examiner* — Nimeshkumar Patel
*Assistant Examiner* — Thomas A Hollweg
(74) *Attorney, Agent, or Firm* — Altis Law Group, Inc.

(57) ABSTRACT

The present invention relates to a sheet-shaped heat and light source. The sheet-shaped heat and light source includes a carbon nanotube layer and at least two electrodes. The at least two electrodes are separately disposed on the carbon nanotube layer and electrically connected thereto. Moreover, a method for making the sheet-shaped heat and light source and a method for heating an object adopting the same are also included.

15 Claims, 5 Drawing Sheets

U.S. PATENT DOCUMENTS 6,294,758 B1 9/2001 Masao et al.
6,369,361 B2 4/2002 Saito et al.
6,407,371 B1 6/2002 Toya et al.
6,422,450 B1 7/2002 Zhou et al.
6,501,056 B1 12/2002 Hirohata et al.
6,541,744 B2 4/2003 Von Arx et al.
6,712,864 B2 3/2004 Horiuchi et al.
6,790,425 B1 9/2004 Smalley et al.
6,809,298 B2 10/2004 Baba et al.
6,872,924 B2 3/2005 Eckert
6,891,263 B2 5/2005 Hiramatsu et al.
6,929,874 B2 8/2005 Hiramatsu et al.
6,949,877 B2 9/2005 Sun et al.
6,957,993 B2 * 10/2005 Jiang et al. ..... 445/50
6,961,516 B2 11/2005 Toya et al.
7,003,253 B2 2/2006 Uchida et al.
7,008,563 B2 3/2006 Smalley et al.
7,045,108 B2 5/2006 Jiang et al.
7,054,064 B2 5/2006 Jiang et al.
7,060,241 B2 6/2006 Glatkowski
7,072,578 B2 7/2006 Saito et al.
7,081,030 B2 7/2006 Liu et al.
7,097,820 B2 8/2006 Colbert et al.
7,105,596 B2 9/2006 Smalley et al.
7,115,013 B2 10/2006 Liu et al.
7,147,831 B2 12/2006 Liu et al.
7,177,579 B2 2/2007 Uchida et al.
7,321,188 B2 * 1/2008 Jiang et al. ..... 313/315
7,357,691 B2 4/2008 Liu et al.
7,615,205 B2 11/2009 Jiang et al.
7,638,933 B2 12/2009 Jiang et al.
7,642,489 B2 1/2010 Liu et al.
7,662,467 B2 2/2010 Li et al.
7,704,480 B2 4/2010 Jiang et al.
7,741,765 B2 6/2010 Liu et al.
7,744,793 B2 * 6/2010 Lemaire et al. ..... 264/172.19
7,780,496 B2 8/2010 Liu et al.
7,785,907 B2 8/2010 Zheng et al.
7,826,199 B2 11/2010 Liu et al.
7,850,778 B2 * 12/2010 Lemaire ..... 118/715
7,854,992 B2 12/2010 Fu et al.
7,947,145 B2 5/2011 Wang et al.
7,947,542 B2 5/2011 Liu et al.
7,947,977 B2 5/2011 Jiang et al.
2002/0040900 A1 4/2002 Arx et al.
2002/0122765 A1 9/2002 Horiuchi et al.
2002/0150524 A1 10/2002 Smalley et al.
2002/0162835 A1 11/2002 Toya et al.
2003/0052585 A1 3/2003 Guillorn et al.
2003/0133865 A1 7/2003 Smalley et al.
2003/0143398 A1 7/2003 Ohki et al.
2003/0164477 A1 9/2003 Zhou et al.
2003/0186625 A1 10/2003 Nakayama et al.
2003/0203225 A1 10/2003 Hiramatsu et al.
2003/0217933 A1 11/2003 Miyagi et al.
2004/0051432 A1 3/2004 Jiang et al.
2004/0099657 A1 5/2004 Park
2004/0109815 A1 6/2004 Liu et al.
2004/0136893 A1 7/2004 Horiuchi et al.
2004/0185320 A1 9/2004 Inagaki et al.
2004/0191158 A1 9/2004 Liu et al.
2004/0195957 A1 10/2004 Hu et al.
2004/0197599 A1 10/2004 Higuchi et al.
2004/0209385 A1 10/2004 Liu et al.
2005/0081983 A1 4/2005 Nakayama et al.
2005/0224764 A1 10/2005 Ma et al.
2005/0236951 A1 10/2005 Liu et al.
2005/0264155 A1 12/2005 Liu et al.
2005/0266766 A1 12/2005 Wei et al.
2006/0035084 A1 2/2006 Liu et al.
2006/0055074 A1 3/2006 Huang et al.
2006/0118768 A1 6/2006 Liu et al.
2006/0135677 A1 6/2006 Huang et al.
2006/0208354 A1 9/2006 Liu et al.
2006/0225163 A1 10/2006 Wei et al.
2006/0231970 A1 10/2006 Huang et al.
2006/0233575 A1 10/2006 Uchida et al.
2006/0234056 A1 10/2006 Huang et al.
2006/0239898 A1 10/2006 Jiang et al.
2006/0263274 A1 11/2006 Jiang et al.
2006/0263524 A1 11/2006 Jiang et al.
2006/0269668 A1 11/2006 Jiang et al.
2006/0269669 A1 11/2006 Jiang et al.
2006/0272061 A1 11/2006 Wei et al.
2007/0003718 A1 1/2007 Nakashima et al.
2007/0116631 A1 * 5/2007 Li et al. ..... 423/447.3
2007/0166223 A1 7/2007 Jiang et al.
2007/0237959 A1 10/2007 Lemaire
2007/0243124 A1 * 10/2007 Baughman et al. ..... 423/447.1
2007/0292614 A1 12/2007 Liu et al.
2007/0296322 A1 12/2007 Liu et al.
2007/0298253 A1 12/2007 Hata et al.
2008/0009434 A1 1/2008 Reches et al.
2008/0018012 A1 * 1/2008 Lemaire et al. ..... 264/82
2008/0063860 A1 3/2008 Song et al.
2008/0122335 A1 5/2008 Liu et al.
2008/0170982 A1 * 7/2008 Zhang et al. ..... 423/447.3
2008/0248235 A1 10/2008 Feng et al.
2008/0292835 A1 11/2008 Pan et al.
2008/0299031 A1 12/2008 Liu et al.
2009/0009634 A1 1/2009 Nakayamai
2009/0016951 A1 1/2009 Kawabata et al.
2009/0057296 A1 3/2009 Niemz et al.
2009/0085461 A1 4/2009 Feng et al.
2009/0096346 A1 4/2009 Liu et al.
2009/0096348 A1 4/2009 Liu et al.
2009/0127743 A1 5/2009 Chan et al.
2009/0156293 A1 6/2009 Inamura
2009/0212040 A1 8/2009 O'Connor
2010/0000989 A1 1/2010 Feng et al.
2010/0126985 A1 5/2010 Feng et al.
2010/0140257 A1 6/2010 Feng et al.
2010/0203316 A1 8/2010 Hata et al.
2010/0244307 A1 * 9/2010 Lemaire et al. ..... 264/171.26

FOREIGN PATENT DOCUMENTS

CN 2455033 10/2001
CN 2494094 5/2002
CN 1483667 A 3/2004
CN 2636571 Y 8/2004
CN 1529334 9/2004
CN 2689638 3/2005
CN 1619800 5/2005
CN 1206699 6/2005
CN 2731895 10/2005
CN 2739909 11/2005
CN 1803594 7/2006
CN 1847144 10/2006
CN 1872673 12/2006
CN 1910771 2/2007
CN 1917135 2/2007
CN 1309770 4/2007
CN 1309770 C 4/2007
CN 2896773 5/2007
CN 101086939 12/2007
CN 101090586 12/2007
CN 101092234 A 12/2007
CN 200994196 Y 12/2007
CN 101102838 1/2008
CN 101121497 2/2008
CN 101138896 3/2008
CN 101192490 6/2008
CN 101239712 8/2008
CN 101284662 10/2008
CN 100443404 12/2008
CN 101314464 A 12/2008
CN 101400198 4/2009
DE 102004044352 3/2006
DE 202005013822 9/2006
DE 202005014678 9/2006
DE 102005038816 B3 1/2007
DE 102006014171 9/2007
EP 2043406 4/2009
JP S56-91391 7/1981
JP 60-159591 8/1985
JP S60-159591 8/1985
JP 64-60988 3/1989

| | | |
|---|---|---|
| JP | S64-60988 | 3/1989 |
| JP | 1-289087 | 11/1989 |
| JP | 2-12190 | 1/1990 |
| JP | 5-343170 | 12/1993 |
| JP | 7-92839 | 4/1995 |
| JP | H07-147183 | 6/1995 |
| JP | H10-319761 | 12/1998 |
| JP | 2000-56605 | 2/2000 |
| JP | 2000-58228 | 2/2000 |
| JP | 2000-77167 | 3/2000 |
| JP | 200077167 | 3/2000 |
| JP | 2002-75604 | 3/2002 |
| JP | 200275602 | 3/2002 |
| JP | 2004-30926 | 1/2004 |
| JP | 2004-186102 | 7/2004 |
| JP | 2004189155 | 7/2004 |
| JP | 2004-528677 | 9/2004 |
| JP | 2005-55317 | 3/2005 |
| JP | 2005-102924 | 4/2005 |
| JP | 2005100757 | 4/2005 |
| JP | 2005-255985 | 9/2005 |
| JP | 2006-228745 | 8/2006 |
| JP | 2006-261131 | 9/2006 |
| JP | 2006-294604 | 10/2006 |
| JP | WO2007015710 | 2/2007 |
| JP | 2007-109640 | 4/2007 |
| JP | 2007-161563 | 6/2007 |
| JP | 2007-263193 | 10/2007 |
| JP | 2007-272223 | 10/2007 |
| JP | 2008-168631 | 7/2008 |
| JP | 2008-523254 | 7/2008 |
| JP | 2009-91239 | 4/2009 |
| JP | 2009-91240 | 4/2009 |
| JP | 2009-94074 | 4/2009 |
| JP | 2009-142633 | 7/2009 |
| JP | 2009-173469 | 8/2009 |
| JP | 2010-3693 | 1/2010 |
| JP | 2010-18515 | 1/2010 |
| KR | 20040010558 | 1/2004 |
| KR | 20050007886 | 1/2005 |
| KR | 20070079862 | 8/2007 |
| KR | 100797094 | 1/2008 |
| TW | 200407259 | 5/2004 |
| TW | 200715334 | 4/2007 |
| TW | 200724486 | 7/2007 |
| TW | 200732250 | 9/2007 |
| TW | 200738553 | 10/2007 |
| TW | 200800793 | 1/2008 |
| TW | 200824903 | 6/2008 |
| TW | I346711 | 8/2011 |
| WO | WO9925154 | 5/1999 |
| WO | WO0217687 | 2/2002 |
| WO | WO0238496 | 5/2002 |
| WO | WO02059936 | 8/2002 |
| WO | 2004/023845 | 3/2004 |
| WO | 2004/082333 | 9/2004 |
| WO | WO2005069412 | 7/2005 |
| WO | WO2006/030981 | 3/2006 |
| WO | 2006064242 A1 | 6/2006 |
| WO | W02006065431 | 6/2006 |
| WO | 2006/122736 | 11/2006 |
| WO | 2007/089118 | 8/2007 |
| WO | WO2007/015710 | 8/2007 |
| WO | WO2007089118 | 8/2007 |
| WO | WO2007/111107 | 10/2007 |
| WO | WO2008133299 | 11/2008 |

OTHER PUBLICATIONS

Yeo-Hwan Yoon,et al. Transparent Film Heater Using Single-Walled Carbon Nanotubes. Advanced Materials, Nov. 29, 2007,4284-4287, 19, Wiley InterScience,Germany.

Wei Jinquan et al: "Carbon nanotube filaments in household light bulbs", Applied Physics Letters, vol. 84, No. 24, pp. 4869-4871 (Jun. 14, 2004).

Petra potschke, Arup R. Bhattacharyya, Andreas Janke: "Carbon nanotube-filled polycarbonate composites produced by melt mixing and their use in blends with polyethylene", Carbon, vol. 42, No. 5-6, pp. 965-969(Jan. 25, 2004).

Jiang KaiLi, Li QunQing, Fan Shou Shan. "Continuous carbon nanobute yarns and their applications". Phys., vol. 32(8), pp. 506-510(Aug. 31, 2003).

Akita et al. "Nano-Processing Tool using a Carbon Nanotube Nano-heater", IEEE Micro Processes and Nanotechnology Conference, 2004, P320-321.

Jiang Kai-Li et al. "Continuous carbon nanotube yarns and their applications" Physics, vol. 32, No. 8, p. 506-510. Abstract and Figure 3 may be relevant.

* cited by examiner

SHEET-SHAPED HEAT AND LIGHT SOURCE, METHOD FOR MAKING THE SAME AND METHOD FOR HEATING OBJECT ADOPTING THE SAME

This application is related to commonly-assigned applications entitled, "SHEET-SHAPED HEAT AND LIGHT SOURCE, METHOD FOR MAKING THE SAME", filed Dec. 29, 2007 Ser. No. 12/006,301; and "SHEET-SHAPED HEAT AND LIGHT SOURCE, METHOD FOR MAKING THE SAME", filed Dec. 29, 2007 Ser. No. 12/006,302. Disclosures of the above-identified applications are incorporated herein by reference.

BACKGROUND

1. Field of the Invention

The invention generally relates to sheet-shaped heat and light sources, methods for making the same and methods for heating objects adopting the same and, particularly, to a carbon nanotube based sheet-shaped heat and light source, a method for making the same and a method for heating objects adopting the same.

2. Discussion of Related Art

Carbon nanotubes (CNT) are a novel carbonaceous material and have received a great deal of interest since the early 1990s. It was reported in an article by Sumio Iijima, entitled "Helical Microtubules of Graphitic Carbon" (Nature, Vol. 354, Nov. 7, 1991, pp. 56-58). CNTs are conductors, chemically stable, and capable of having a very small diameter (much less than 100 nanometers) and large aspect ratios (length/diameter). Due to these and other properties, it has been suggested that CNTs should play an important role in various fields, such as field emission devices, new optic materials, sensors, soft ferromagnetic materials, etc. Moreover, due to CNTs having excellent electrical conductivity, thermal stability, and light emitting property similar to black/black-body radiation, carbon nanotubes can also, advantageously, be used in the field of heat and light sources.

A carbon nanotube yarn drawn from an array of carbon nanotubes and affixed with two electrodes, emits light, when a voltage is applied across the electrodes. The electrical resistance of the carbon nanotube yarn does not increase as much, as metallic light filaments, with increasing temperature. Accordingly, power consumption, of the carbon nanotube yarn, is low at incandescent operating temperatures. However, carbon nanotube yarn is a linear heat and light source, and therefore, difficult to use in a sheet-shaped heat and light source.

Non-linear sheet-shaped heat and light source, generally, includes a quartz glass shell, two or more tungsten filaments or at least one tungsten sheet, a supporting ring, sealing parts, and a base. Two ends of each tungsten filament are connected to the supporting ring. In order to form a planar light emitting surface, the at least two tungsten filaments are disposed parallel to each other. The supporting ring is connected to the sealing parts. The supporting ring and the sealing parts are disposed on the base, thereby, defining a closed space. An inert gas is allowed into the closed space to prevent oxidation of the tungsten filaments. However, they are problems with the sheet-shaped heat and light source: Firstly, because tungsten filaments/sheets are grey-body radiation emitters, the temperature of tungsten filaments/sheets increases slowly, thus, they have a low efficiency of heat radiation. As such, distance of heat radiation transmission is relatively small. Secondly, heat radiation and light radiation are not uniform. Thirdly, tungsten filaments/sheets are difficult to process.

Further, during light emission, the tungsten filaments/sheets maybe need a protective work environment.

What is needed, therefore, is a sheet-shaped heat and light source having a large area, uniform heat and light radiation, a method for making the same being simple and easy to be applied, and a method for heating an object adopting the same.

SUMMARY

A sheet-shaped heat and light source includes a first electrode, a second electrode, and a carbon nanotube layer. The first electrode and the second electrode are separately disposed on the carbon nanotube layer at a certain distance and electrically connected thereto.

Other advantages and novel features of the present sheet-shaped heat and light source, the method for making the same, and a method for heating object adopting the same will become more apparent from the following detailed description of present embodiments when taken in conjunction with the accompanying drawings.

BRIEF DESCRIPTION OF THE DRAWINGS

Many aspects of the present sheet-shaped heat and light source, the method for making the same, and a method for heating object adopting the same can be better understood with reference to the following drawings. The components in the drawings are not necessarily to scale, the emphasis instead being placed upon clearly illustrating the principles of the present sheet-shaped heat and light source, the method for making the same, and a method for heating an object adopting the same.

Figure 1:
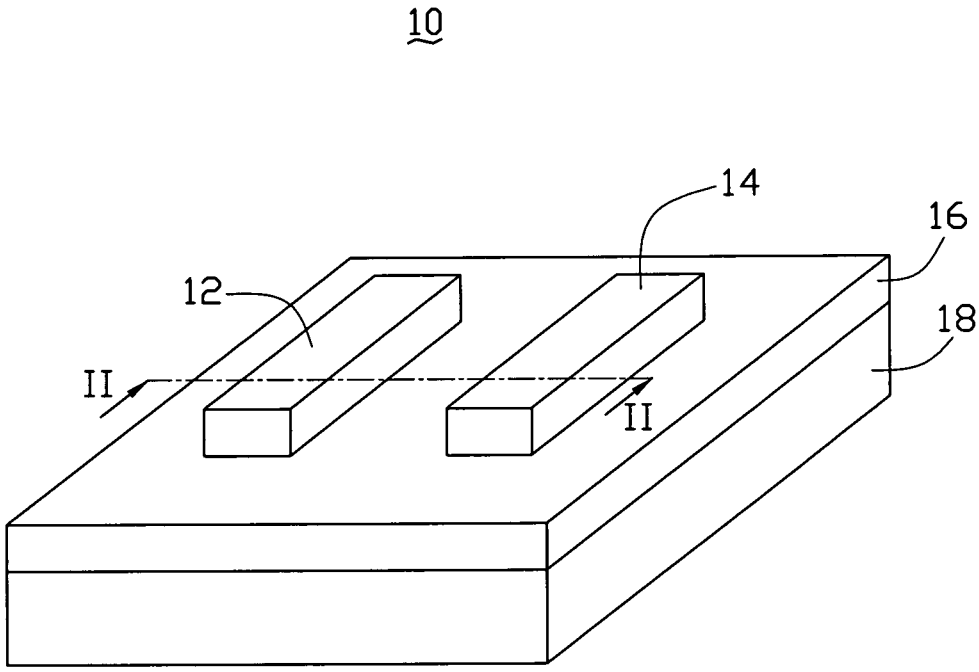
FIG. 1 is a schematic view of a sheet-shaped heat and light source, in accordance with the present embodiment.

Corresponding reference characters indicate corresponding parts throughout the several views. The exemplifications set out herein illustrate at least one present embodiment of the sheet-shaped heat and light source, the method for making the same, and a method for heating object adopting the same, in at least one form, and such exemplifications are not to be construed as limiting the scope of the invention in any manner.

DETAILED DESCRIPTION OF PREFERRED EMBODIMENTS

Reference will now be made to the drawings, in detail, to describe embodiments of the sheet-shaped heat and light source, the method for making the same, and a method for heating an object adopting the same.

Figure 2:
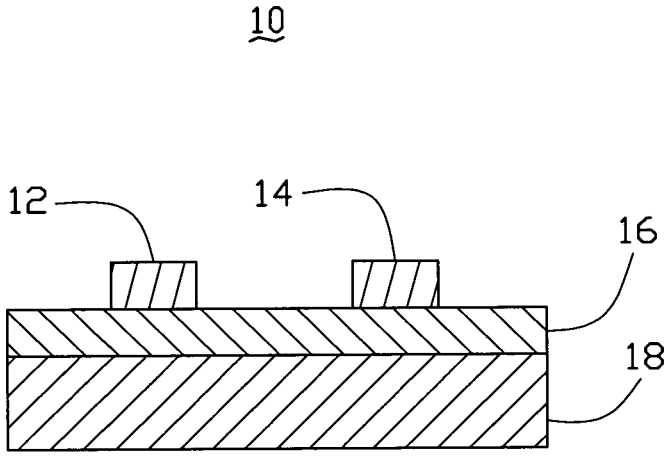
FIG. 2 is a cross-sectional schematic view of FIG. 1 along a line II-II'.

Referring to FIGS. 1 and 2, a sheet-shaped heat and light source 10 is provided in the present embodiment. The sheet-shaped heat and light source 10 includes a first electrode 12, a second electrode 14, a carbon nanotube layer 16, and a base 18. The first electrode 12 and the second electrode 14 are separately disposed on the carbon nanotube layer 16 at a certain distance apart and electrically connected thereto.

Further, the carbon nanotube layer 16 includes at least two overlapping carbon nanotube films. The adjacent carbon nanotube films are combined and coupled by van der Waals attractive force to form a carbon nanotube layer. Each of the carbon nanotube films includes a plurality of carbon nanotube bundles. Each of the carbon nanotube bundles includes a plurality of carbon nanotubes arranged in a preferred orientation. Adjacent carbon nanotube bundles are combined by van der Waals attractive force to connect with each other. In one useful embodiment, a thickness of the carbon nanotube film is in an approximate range from 0.01 microns to 10 microns.

It is to be noted that the carbon nanotube layer can, opportunely, include many layers of carbon nanotube films overlapping each other to form an integrated carbon nanotube layer with an angle of $\alpha$, $0 \leqq \alpha \leqq 90°$. The specific degree of $\alpha$ depends on practical needs. That is, the nanotubes of one carbon nanotube film are oriented in a same direction and the nanotubes in an adjacent carbon nanotube film are all oriented in a direction 0-90 degrees different from the first film, and $\alpha$ is the angle of difference between the two orientations.

Due to the carbon nanotube film having good tensile strength, it can, advantageously, be formed into almost any desired shape. As such, the carbon nanotube films/layer can, opportunely, have a planar or curved structure. In the present embodiment, the carbon nanotube layer 16 has a planar structure. In this embodiment, the carbon nanotube layer 16 is formed by overlapping or stacking 100 carbon nanotube films. The nanotubes of one carbon nanotube film are oriented in a same direction and successive carbon nanotube films forming a layer are disposed with respective nanotube orientation in the approximate range from 0 degrees to 90 degrees in relation to adjacent carbon nanotube films. And in this embodiment 90 degrees is used. A length of each carbon nanotube film is about 30 centimeters. A width of each carbon nanotube film is about 30 centimeters. A thickness of each carbon nanotube film is about 50 millimeters.

It is to be understood that, the first electrode 12 and the second electrode 14 can, opportunely, be disposed on a same surface or different surfaces of the carbon nanotube layer 16. Further, it is imperative that the first electrode 12 and the second electrode 14 are separated by a certain distance to form a certain resistance therebetween, thereby preventing short circuiting of the electrodes. In the present embodiment, because of the adhesive properties of the carbon nanotube film, the first electrode 12 and the second electrode 14 are directly attached to the carbon nanotube layer 16, and thereby forming an electrical contact therebetween. Alternatively, the first electrode 12 and the second electrode 14 are attached on the same surface of the carbon nanotube layer 16 by a conductive adhesive. Quite suitably, the conductive adhesive material is an adhesive of silver. It should be noted that any other bonding ways can be adopted as long as the first electrode 12 and the second electrode 14 are electrically connected to the carbon nanotube layer 16.

The base 18 is selected from the group consisting of ceramic, glass, resin, and quartz. The base 18 is used to support the carbon nanotube layer 16. The shape of the base 18 can be determined according to practical needs. In the present embodiment, the base 18 is a ceramic substrate. Due to the free-standing property of the carbon nanotube layer 16, the sheet-shaped heat and light source 10 can, benefically, be without the base 18.

Figure 3:
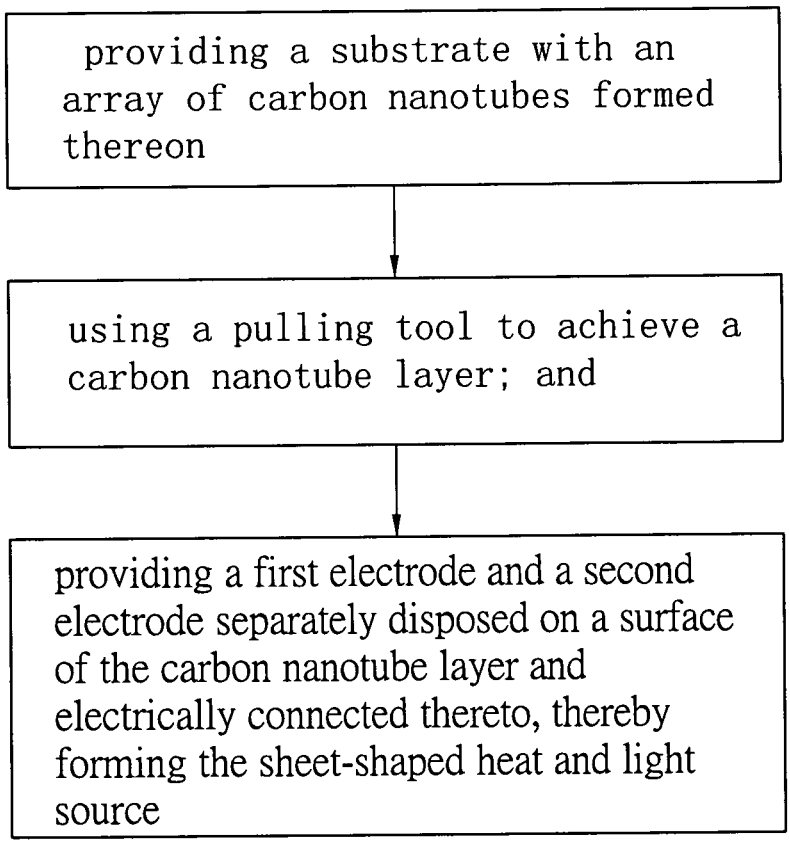
FIG. 3 is a flow chart of a method for making the sheet-shaped heat and light source shown in FIG. 1.

Referring to FIG. 3, a method for making the above-described sheet-shaped heat and light source 10 are provided in the present embodiment. The method includes the steps of: (a) providing a substrate with an array of carbon nanotubes formed thereon; (b) using a pulling tool to achieve the carbon nanotube layer 16, and (c) providing a first electrode and a second electrode separately disposed on a surface of the carbon nanotube layer and electrically connected thereto, thereby forming the sheet-shaped heat and light source 10.

In step (a), an array of carbon nanotubes, quite suitably, a super-aligned array of carbon nanotubes is provided. The given super-aligned array of carbon nanotubes can be formed by the steps of: (a1) providing a substantially flat and smooth substrate; (a2) forming a catalyst layer on the substrate; (a3) annealing the substrate with the catalyst layer in air at a temperature in the approximate range from 700° C. to 900° C. for about 30 to 90 minutes; (a4) heating the substrate with the catalyst layer at a temperature in the approximate range from 500° C. to 740° C. in a furnace with a protective gas therein; and (a5) supplying a carbon source gas to the furnace for about 5 to 30 minutes and growing a super-aligned array of carbon nanotubes on the substrate.

In step (a1), the substrate can be a P-type silicon wafer, an N-type silicon wafer, or a silicon wafer with a film of silicon dioxide thereon. Preferably, a 4 inch P-type silicon wafer is used as the substrate. In step (a2), the catalyst can, advantageously, be made of iron (Fe), cobalt (Co), nickel (Ni), or any alloy thereof.

In step (a4), the protective gas can, beneficially, be made of at least one of nitrogen ($N_2$), ammonia ($NH_3$), and a noble gas. In step (a5), the carbon source gas can be a hydrocarbon gas, such as ethylene ($C_2H_4$), methane ($CH_4$), acetylene ($C_2H_2$), ethane ($C_2H_6$), or any combination thereof.

The super-aligned array of carbon nanotubes can, opportunely, have a height of about above 100 microns and includes a plurality of carbon nanotubes parallel to each other and approximately perpendicular to the substrate. The super-aligned array of carbon nanotubes formed under the above conditions is essentially free of impurities, such as carbonaceous or residual catalyst particles. The carbon nanotubes in the super-aligned array are closely packed together by the van der Waals attractive force. The carbon nanotubes can be single-walled carbon nanotubes, double-walled carbon nanotubes or multi-walled carbon nanotubes.

In step (b), the carbon nanotube layer can be formed by the steps of: (b1) selecting carbon nanotube segments and using an adhesive tape as a tool to contact with the super-aligned array; (b2) drawing the carbon nanotube segments along a direction perpendicular to the growing direction of the super-aligned array of carbon nanotubes to form a carbon nanotube film; and (b3) overlapping at least two above-described carbon nanotube films to form the carbon nanotube layer 16.

In step (b1), quite usefully, the carbon nanotube segments having a predetermined width can be selected by using an adhesive tape as the tool to contact with the super-aligned array.

In step (b2), more specifically, during the pulling process, as the initial carbon nanotube segments are drawn out, other carbon nanotube segments are also drawn out end to end, due to the van der Waals attractive force between ends of adjacent segments. The carbon nanotube film produced in such manner can be selectively formed having a predetermined width. The carbon nanotube film includes a plurality of carbon nanotube segments. The carbon nanotubes in the carbon nanotube film are all substantially parallel to the pulling direction of the carbon nanotube film.

In step (b3), the nanotubes of one film are oriented in a same direction and the tubes in an adjacent film are all oriented in a direction 0-90 degrees different from the first film. In this embodiment, 90 degrees is used.

The width of the carbon nanotube film depends on a size of the carbon nanotube array. The length of the carbon nanotube film can arbitrarily be set as desired. In one useful embodiment, when the substrate is a 4 inch type wafer as in the present embodiment, a width of the carbon nanotube film is in an approximate range from 1 centimeter to 10 centimeters, a thickness of the carbon nanotube film is in an approximate range from 0.01 microns to 10 microns, and a thickness of the carbon nanotube layer is in an approximate range from 0.01 microns to 100 microns.

It is noted that, because the carbon nanotubes in the super-aligned array have a high purity and a high specific surface area, the carbon nanotube film is adhesive. As such, the carbon nanotube film can adhere to the surface of the base 18 directly.

Quite usefully, the carbon nanotube layer can be treated with an organic solvent. The organic solvent is volatilizable and can be selected from the group consisting of ethanol, methanol, acetone, dichloroethane, and chloroform. Quite suitably, the organic solvent is dropped on the carbon nanotube layer 16 through a dropping tube in the present embodiment. After soaking in the organic solvent, the carbon nanotube segments in the carbon nanotube film can at least partially compact/shrink into carbon nanotube bundles due to the surface tension of the organic solvent. Due to the decrease of the surface area, the carbon nanotube layer 16 loses viscosity but maintains high mechanical strength and toughness.

In practical use, the carbon nanotube layer 16 can, beneficially, be disposed on the base 18. The base 18 is selected from the group consisting of ceramic, glass, resin, and quartz. The base 18 is used to support the carbon nanotube layer 16. The shape of the base 18 can be determined according to practical needs. In the present embodiment, the base 18 is a ceramic substrate. Moreover, due to the carbon nanotube layer 16 having a free-standing property, in practice, the carbon nanotube films can, benefically, be disposed on a frame, thereby forming the carbon nanotube layer 16. Whereby the frame can be removed. Accordingly, the carbon nanotube layer 16 can, opportunely, be used in the sheet-shaped heat and light source 10 without the base 18.

In a process of using the sheet-shaped heat and light source 10, when a voltage is applied to the first electrode 12 and the second electrode 14, the carbon nanotube layer 16 of the sheet-shaped heat and light source 10 emits electromagnetic waves with a certain wavelength. Quite suitably, when the carbon nanotube layer 16 of the sheet-shaped heat and light source 10 has a fixed surface area (length * width), the voltage and the number of layers of carbon nanotube films in the carbon nanotube layer 16 can, opportunely, be used to make the carbon nanotube layer 16 emit electromagnetic waves at different wavelengths. If the voltage is fixed at a certain value, the electromagnetic waves emitting from the carbon nanotube layer 16 are inversely proportional to the number of layers of carbon nanotube films. That is, the more layers of carbon nanotube film, the shorter the wavelength of the electromagnetic waves. Further, if the number of layers of carbon nanotube film is fixed at a certain value, the greater the voltage applied to electrodes, the shorter the wavelength of the electromagnetic waves. As such, the sheet-shaped heat and light source 10, can easily be configured to emit a visible light and create general thermal radiation or emit infrared radiation.

In the present embodiment, the adjacent carbon nanotube films overlapping each other form an integral carbon nanotube layer with an angle of $\alpha$ meeting the following condition, $0 \leqq \alpha \leqq 90°$. Therefore, this structure can, advantageously, make the sheet-shaped heat and light source 10 work stably, and create uniform visible light, thereby generating stable thermal radiation.

As such, due to carbon nanotubes having an ideal black body structure, the carbon nanotube layer 16 has excellent electrical conductivity, thermal stability, and high thermal radiation efficiency. The sheet-shaped heat and light source 10 can, advantageously, be safely exposed, while working, to oxidizing gases in a typical environment. When a voltage of 10 volts~30 volts is applied to the electrodes, the sheet-shaped heat and light source 10 emits electromagnetic waves. At the same time, the temperature of sheet-shaped heat and light source 10 is in the approximate range from 50° C. to 500° C.

In the present embodiment, the surface area of the carbon nanotube layer 16 is 900 square centimeters. Specifically, both the length and the width of the carbon nanotube layer 16 are 30 centimeters. The carbon nanotube layer 16 includes 100 carbon nanotube films overlapping each other to form an integral carbon nanotube layer with an angle of $\alpha$ from 0 to 90 degrees. The nanotubes of one film are oriented in a same direction and the nanotubes in an adjacent film are all oriented in a direction 0-90 degrees different from the first film. In this embodiment, 90 degrees is used.

Further, quite suitably, the sheet-shaped heat and light source 10 is disposed in a vacuum device or a device with inert gas filled therein. When the voltage is increased in the approximate range from 80 volts to 150 volts, the sheet-shaped heat and light source 10 emits electromagnetic waves such as visible light (i.e. red light, yellow light etc), general thermal radiation, and ultraviolet radiation.

It is to be noted that the sheet-shaped heat and light source 10 can, beneficially, be used as electric heaters, infrared therapy devices, electric radiators, and other related devices. Moreover, the sheet-shaped heat and light source 10 can, beneficially, be used as light sources, displays, and other related devices.

Figure 4:
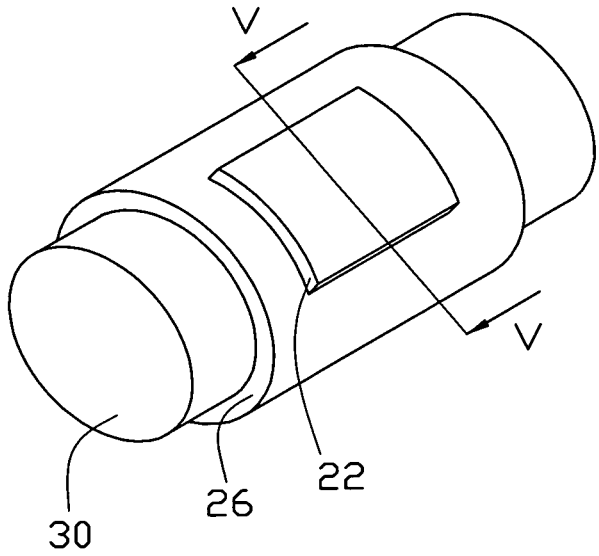
FIG. 4 is a schematic view of heating an object using the sheet-shaped heat and light source shown in FIG. 1.
Figure 5:
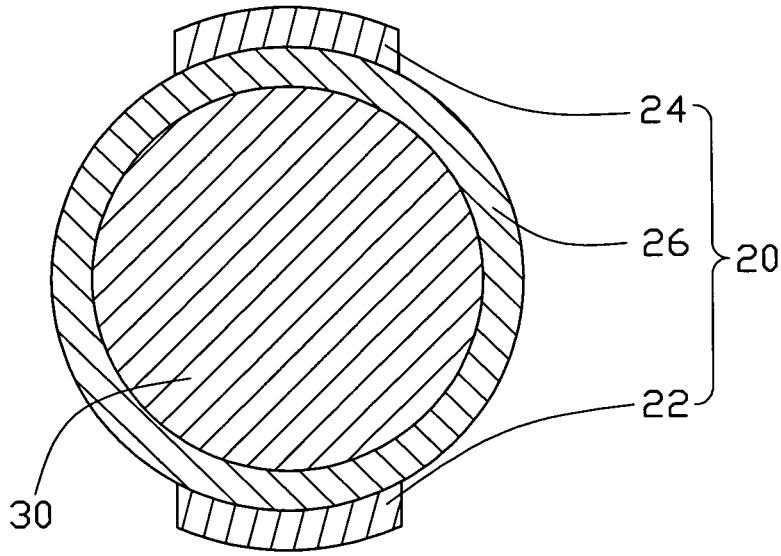
FIG. 5 is a cross-sectional schematic view of FIG. 4 along a line V-V'.

Referring to FIGS. 4 and 5, a method for heating an object adopting the above-described sheet-shaped heat and light source 20 is also described. In the present embodiment, the sheet-shaped heat and light source 20 includes a first electrode 22, a second electrode 24, and a carbon nanotube layer 26. Further, the first electrode 24 and the second electrode 26 are separately disposed on the carbon nanotube layer 26 at a certain distance apart and electrically connected thereto. The method includes the steps of: providing an object 30; disposing a carbon nanotubes layer 26 of the sheet-shaped heat and light source 20 to a surface of the object 30; and applying a voltage between the first electrode 22 and the second electrode 24 to heat the object 30.

Due to the carbon nanotube layer 26 having a free-standing property, the sheet-shaped heat and light source 20 can be without a base. Because the carbon nanotube layer 26 has excellent tensile strength, the sheet-shaped heat and light source 10 has advantageously a ring-shaped carbon nanotube layer 26. Further, the surface area of the carbon nanotube layer 26 is 900 square centimeters. Specifically, both the length and the width of the carbon nanotube layer 26 are 30 centimeters. The carbon nanotube layer 26 includes 100 carbon nanotube films. The adjacent carbon nanotube films are overlapped and perpendicular to each other. The voltage applied to the electrode 12 and the electrode 14 is 15 volts. The temperature of the sheet-shaped heat and light source 10 is about 300° C. Quite suitably, in the process of heating the object 30, the object 30 and the carbon nanotube layer 26 may be in contact with each other or may be separated from each other, at a certain distance, as required.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A sheet-shaped heat and light source comprising:

a carbon nanotube layer consisting of carbon nanotubes, the carbon nanotube layer being exposed to an oxidizing gas and capable of generating a temperature in a range from about 50° C. to 500° C. by applying a voltage in a range from about 10 volts to about 30 volts; and at least two electrodes separately and directly attached to the carbon nanotube layer, and electrically connected to the carbon nanotube layer, wherein the carbon nanotube layer consists of a hundred of carbon nanotube films overlapped with each other, a length and a width of each of the carbon nanotube films are both about thirty centimeters.

2. The sheet-shaped heat and light source as claimed in claim 1, wherein each of the carbon nanotube films comprises a plurality of carbon nanotubes joined end-to-end and substantially oriented in a same direction.

3. The sheet-shaped heat and light source as claimed in claim 1, wherein each of the hundred of carbon nanotube films consists a plurality of carbon nanotubes substantially oriented in a same direction.

4. The sheet-shaped heat and light source as claimed in claim 3, wherein the plurality of carbon nanotubes in adjacent two carbon nanotube films of the hundred of carbon nanotube films are oriented along different directions.

5. The sheet-shaped heat and light source as claimed in claim 1, wherein each of the hundred of carbon nanotube films consists a plurality of carbon nanotube bundles joined thereof by van der Waals attractive force therebetween, and the adjacent carbon nanotube bundles are combined by van der Waals attractive force.

6. The sheet-shaped heat and light source as claimed in claim 1, wherein a thickness of each of the hundred of carbon nanotube films is in the approximate range from 0.01 micrometers to 100 micrometers.

7. The sheet-shaped heat and light source as claimed in claim 1, wherein the at least two electrodes comprise at least one of metal films and metal foils.

8. The sheet-shaped heat and light source as claimed in claim 1, wherein the at least two electrodes are disposed on a surface or opposite surfaces of the carbon nanotube layer.

9. The sheet-shaped heat and light source as claimed in claim 8, wherein the at least two electrodes are attached on the surface or opposite surfaces of the carbon nanotube layer by conductive adhesive.

10. The sheet-shaped heat and light source as claimed in claim 8, wherein the carbon nanotube layer has a planar or curved structure.

11. The sheet-shaped heat and light source as claimed in claim 1, further comprising a device, the carbon nanotube layer being disposed in the device, wherein the device is a vacuum device or a device filled with inert gases.

12. The sheet-shaped heat and light source as claimed in claim 1, wherein each of the hundred of carbon nanotube films consists a plurality of carbon nanotubes joined end-to-end and substantially oriented in a same direction.

13. A method for heating an object by a sheet-shaped heat and light source comprising:

providing the sheet-shaped heat and light source comprising:

a carbon nanotube layer consisting of carbon nanotubes, the carbon nanotube layer being exposed to an oxidizing gas and capable of generating a temperature in a range from about 50° C. to 500° C. by applying a voltage in a range from about 10 volts to about 30 volts; and at least two electrodes separately and directly attached to the carbon nanotube layer, and electrically connected to the carbon nanotube layer;

disposing the carbon nanotube layer of the sheet-shaped heat and light source to a surface of the object; and applying the voltage in a range from about 10 volts to about 30 volts between the at least two electrodes of the sheet-shaped heat and light source to heat the object wherein the carbon nanotube layer consists of a hundred of carbon nanotube films overlapped with each other, a length and a width of each of the carbon nanotube films are both about thirty centimeters.

14. The method as claimed in claim 13, wherein the carbon nanotube layer is separated from the object at a distance.

15. The method as claimed in claim 13, wherein each of the carbon nanotube films comprises a plurality of carbon nanotubes joined end-to-end and substantially oriented in a same direction.

* * * * *